United States Patent [19]

La Barge et al.

[11] 4,105,133

[45] Aug. 8, 1978

[54] CONTAINER WALL WITH RUPTURABLE WEAKENING LINE

[75] Inventors: Robert L. La Barge, Ben Avon, Pa.; Robert G. Clawson, Pershing, Ind.

[73] Assignee: Aluminum Company of America, Pittsburgh, Pa.

[21] Appl. No.: 684,836

[22] Filed: May 10, 1976

Related U.S. Application Data

[63] Continuation of Ser. No. 517,324, Oct. 23, 1974, abandoned, which is a continuation-in-part of Ser. No. 287,525, Sep. 8, 1972, abandoned.

[51] Int. Cl.[2] ..... B65D 17/00

[52] U.S. Cl. ..... 220/266; 220/367; 220/DIG. 27

[58] Field of Search ..... 220/265, 266, 267, 268, 220/269, 270, 271, 281, 367

[56] References Cited

U.S. PATENT DOCUMENTS

| | | | |
|---|---|---|---|
| 1,098,444 | 6/1914 | Ingalls | 220/274 |
| 1,359,651 | 11/1920 | Andrews | 220/266 |
| 1,743,283 | 1/1930 | Porges | 222/109 |
| 3,227,304 | 1/1966 | Asbury | 220/268 |
| 3,229,847 | 1/1966 | Fox, Jr. | 220/267 |
| 3,246,791 | 4/1966 | Asbury | 220/268 |
| 3,355,058 | 11/1967 | Asbury | 220/269 |
| 3,416,698 | 12/1968 | Arfert | 220/270 |
| 3,720,348 | 3/1973 | Jakobsen | 220/271 |
| 3,779,417 | 12/1973 | Klein | 220/269 |
| 3,794,206 | 2/1974 | De Line | 220/281 |

FOREIGN PATENT DOCUMENTS

| | | | |
|---|---|---|---|
| 555,690 | 4/1956 | Italy | 215/253 |

*Primary Examiner*—Ro E. Hart
*Attorney, Agent, or Firm*—David W. Brownlee

[57] ABSTRACT

A sheet metal container wall or end closure is provided which includes a weakening line in the sheet metal and a rib formed across the weakening line to facilitate rupture of the residual metal in the weakening line. Such container wall may also have a hollow button formed in it with the weakening line and rib formed in the button whereby flexing of the button stresses the rib and weakening line to initiate rupture of the residual metal in the weakening line.

24 Claims, 9 Drawing Figures

CONTAINER WALL WITH RUPTURABLE WEAKENING LINE

REFERENCE TO RELATED APPLICATION

This application is a continuation of application Ser. No. 517,324, filed Oct. 23, 1974, now abandoned which is a continuation-in-part of our application Ser. No. 287,525, filed Sept. 8, 1972 for "Container Wall with Rupturable Weakening Line" now abandoned.

BACKGROUND OF THE INVENTION

Can ends and end closures are known which include rupturable weakening lines or score lines defining panels which are at least partially removable from the ends and which further include embossments or buttons raised in the panels for depressing the panels to rupture the score lines without the need for auxiliary tools or pull tabs attached to the panels. Can ends of this type are disclosed in U.S. Pat. Nos. 3,227,304, 3,246,791 and 3,355,058, among others. It is also known to provide an auxiliary score which is positioned close enough to the primary score around a removable panel to lessen the force which is required to initiate rupture of the primary score as is disclosed in U.S. Pat. No. 3,422,983. A further disclosure of interest is contained in U.S. Pat. No. 1,098,444 which teaches the provision of V-shaped dents in a metal container wall along a weakening line to form buttresses against the sides of the weakening line to prevent tearing into the metal adjacent the weakening lines. U.S. Pat. No. 3,416,698 is of interest for its disclosure of a reinforcing bead across a score line to require a greater force to tear across the bead and provide protection against blowout of a tear strip defined by the score line.

SUMMARY OF THE INVENTION

This invention provides a container wall or end closure which includes a weakening line and a rib formed across the weakening line to facilitate rupture of the weakening line. This invention further includes a button formed in the container wall, and the weakening line and rib are formed in the button to facilitate rupture of the weakening line when the button is flexed.

Accordingly, an object of the invention is to provide a container wall with a weakening line therein which can be easily ruptured.

Another object of the invention is to provide a container wall with a weakening line formed therein and a rib or bead formed across the weakening line.

A further object of the invention is to provide a container wall with a flexible button formed in it which will facilitate rupture of a weakening line in the wall when the button is flexed.

BRIEF DESCRIPTION OF THE DRAWINGS

The above and other objects and advantages of the invention will be more fully understood and appreciated with reference to the following description and the drawings appended hereto wherein.

DESCRIPTION OF PREFERRED EMBODIMENTS OF THE INVENTION

According to this invention, a rib or ribs are formed in a container wall across a weakening line in the container wall to provide a stress riser in the weakening line which will facilitate initiation of rupture of the weakening line. Such a rib in a container wall acts as a beam section in the wall and the score across the beam section weakens the beam at the point of maximum tensional stress when the beam is loaded. Consequently, the beam can be easily broken as can a notched stick.

This invention may further include a button in a container wall in which the weakening line and rib are formed. This button can be flexed to bend the rib or beam section and thereby initiate rupture of the residual metal in the weakening line. Flexible buttons are known for some applications such as use in a baby food closure to indicate the existence of a vacuum in a bottle on which the closure is sealed, but have not been known for use in facilitating rupture of a weakening line in a container wall.

In order to facilitate understanding of the subject invention and in the interest of clarity, the terms "inwardly" and "outwardly" will be herein employed to delineate directions relative to the interior and exterior respectively of a container having a container wall or closure of the invention secured thereon.

Figure 1:
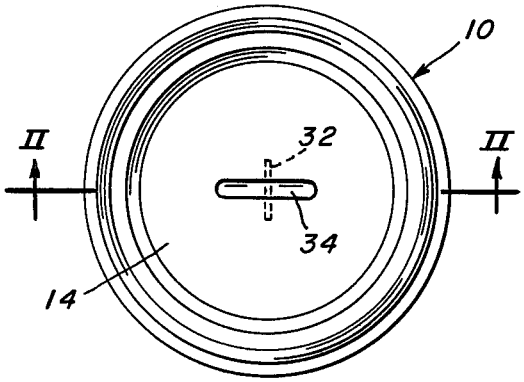
FIG. 1 is a top plan view of a closure of the invention.
Figure 2:
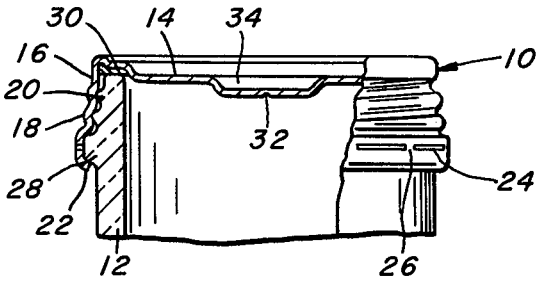
FIG. 2 is a partial cross-section through the closure of FIG. 1 taken along lines II—II, showing the closure secured on a container.

Referring to FIGS. 1 and 2, a preferred embodiment of the invention is illustrated as comprising a closure 10 which is made of sheet metal, preferably aluminum or an alloy thereof, and which is at least an intermediate temper alloy, and preferably a hard temper alloy. The sheet metal from which the closure is formed may have a thickness in a range of 0.006 to 0.012 inch, with a 0.009 inch thickness being common. The closure 10 is adapted to be secured on a container 12 by threads or other conventional attachment means. It has a top end wall 14 and a depending peripheral skirt 16 which may have threads 18 formed therein for engaging threads 20 on container 12, and may have a pilferproof or locking band 22 on the bottom of the skirt. Pilferproof band 22 may be separated from the top portion of skirt 16 by a line of slits 24 and bridges 26, and is adapted to have a lower edge portion turned under a shoulder or bead 28 on container 12. Closure 10 may further have a ring or liner of gasket material 30 on the under surface of top end wall 14 around its outer edge for sealing against a top sealing surface on container 12.

In accordance with this invention, closure 10 further has a weakening line or score 32 in top end wall 14 and an embossed rib 34 formed across the score line. In the embodiment selected for illustration in FIGS. 1–3, rib 34 is formed downwardly in closure 10 and has a relatively small radius in its bottom so there will be a minimum of metal section at the bottom or apex of the rib.

Figure 3:
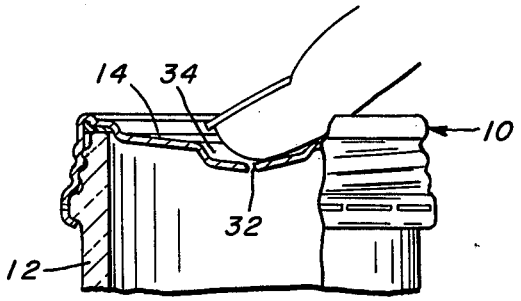
FIG. 3 is a cross-section similar to FIG. 2 illustrating rupture of the score in the closure.

The combination of a minimum metal section at the apex of rib 34 and the weakening provided by score 32 where it crosses the rib and makes it very easy to rupture the residual of metal in the score when the panel 14 is depressed as is illustrated in FIG. 3. Depressing panel 14 places a maximum load at the center of rib 34 which results in a maximum tensional stress across the score which ruptures the residual metal in the score where it crosses the rib.

The rib 34 is preferably substantially V-shaped with a relatively small radius at its corner, but may also be U-shaped or have a semi-circular cross sectional configuration. A sharp "V" will produce the highest stresses in the apex of the rib, but a "U" or semi-circular configuration will also function in accordance with this invention. The rib or beam need not be straight and need not be located in the center of the closure as in the closure which has been selected for purposes of illustration.

Figure 4:
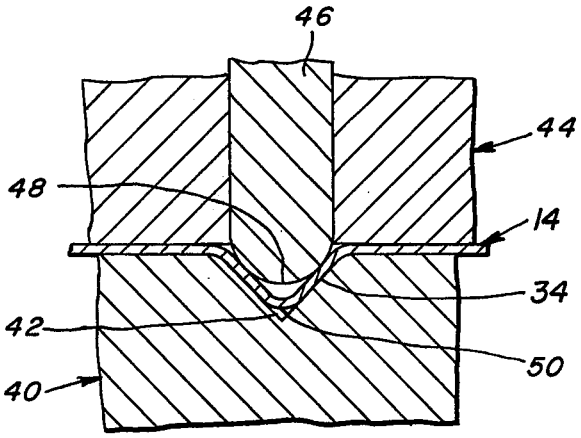
FIG. 4 is an enlarged cross-section showing forming of the rib in a closure of the invention.

FIG. 4 shows tools which may be used to form a rib in a container wall in accordance with this invention. Preferably, the container wall will have been scored prior to the forming of a rib therein. Tools for forming a rib in a container wall 36 may comprise a lower die 40 with a V-shaped groove 42 in it and an upper die 44 which includes a blade 46 having a rounded nose 48 which can be moved downwardly against container wall 36 and into groove 42 to form a V-shaped rib 38 with a relatively small radius 50 at its apex. Moving blade 46 against container wall 36 into groove 42 draws metal from the container wall into the groove and may coin the container wall between the nose of the blade and the walls of the groove to extrude metal downwardly into the groove. Such extrusion makes it possible to form a relatively deep groove or rib which is desired for practice of this invention. It also thins the metal at the base of the rib which may facilitate rupture of the score line across the rib.

The rib 34 which is formed in the closure 10 should project from the panel 14 a distance of at least approximately five times the metal thickness, and preferably 7.5 to 8 or more times the metal thickness to minimize the force required to fracture the score line. A closure of the invention can desirably be opened with a force of approximately 12 to 18 pounds. Such force can be easily applied by most adults.

Figure 6:
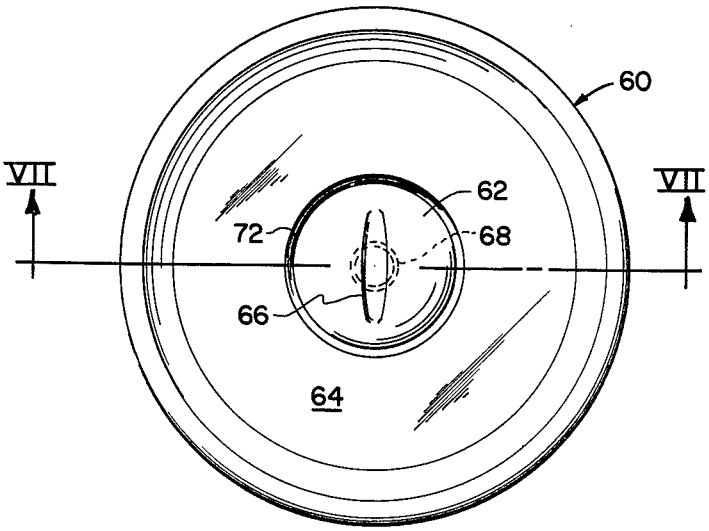
FIG. 6 is a top plan view of an alternative embodiment of a closure of this invention.

The upper limit of the rib height is primarily a matter of ability to form such a rib, and not a matter of functioning of the rib. To form a rib having a height of over five or six times the metal height in a sheet metal aluminum closure usually requires both drawing and extruding the rib in the manner which is illustrated in FIG. 6. A sheet metal aluminum closure is subject to tearing or rupture of the metal during forming when a rib having a height of over 5–6 times the metal thickness is formed by a one step drawing operation without also extruding the metal.

The rib 34 should be at least 0.5 inch long and is preferably at least 0.6 to 0.8 inch long in a closure formed from 0.009 inch thick aluminum alloy. A rib at 0.6 inch long is desired to provide leverage for stressing the residual metal in the score line across the rib. If the rib is too short, it is more difficult to rupture the score line in the closure, much as it is more difficult to break a short stick than a long stick.

The rib may have a width which is approximately one to three times the height of the rib. The width of the rib is not believed to be critical to the functioning of the invention.

The score line 32 is preferably long enough that its terminal ends extend beyond the width of the base of the rib 34. The ends of the score line also are preferably tapered gradually such as at approximately a 3° angle on both ends of the score line from full score depth in the middle portion of the score line to zero score depth at its terminal ends. This taper on the ends of the score line is believed to help prevent accidental rupture of the score during forming of the rib.

In a preferred embodiment of this invention, the score line is relatively shallow, such as approximately one-third to one-quarter of the thickness of the sheet material from which the closure is formed. For example, the score line in a closure made from 0.009 inch sheet stock may be approximately 0.0025 inch deep. A deeper score is within the scope of this invention, and in fact would be easier to fracture with digitally applied pressure, but it would also be more likely to be accidentally ruptured as during forming of the rib in the closure. Further, with a relatively high rib, the stresses produced in the score by digitally applied pressure against the rib is great enough that even a relatively shallow score can be easily ruptured to produce an opening in the closure wall. The opening force is also less affected by score residual in a closure having a relatively high rib than it would in a closure having a lower rib. Required opening force is also less affected by metal alloy, temper, thickness, and other variables in the closure having a relatively high rib.

Figure 5:
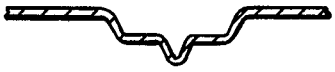
FIG. 5 is a cross-section through an alternative rib which may be used in the invention.

FIG. 5 illustrates a cross section through an alternative rib configuration which can be formed in a container wall of the invention. This rib has such a relatively wide base and also has a relatively sharp radius on its apex to facilitate initiation of rupture of a score across the rib. It will be apparent to those skilled in the art that other rib cross-section may also be used. Preferably, any such rib will provide a minimum metal section in its side or edge which will be in tension when the rib is loaded or flexed to rupture the score, and a maximum metal section in the side or edge of the rib which will be in compression when the rib is so flexed.

Figure 7:
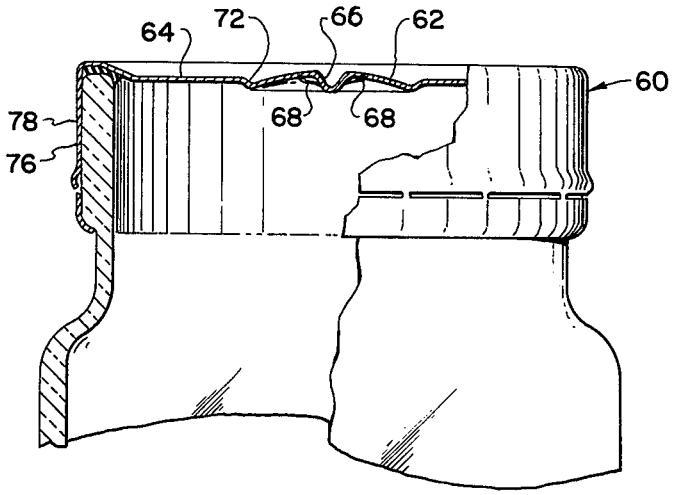
FIG. 7 is a partial cross-section through the closure of FIG. 6 taken along line VII—VII showing the closure sealed on a container.

FIGS. 6 and 7 show another embodiment of a closure and container-closure assembly of this invention in which the closure 60 has an integral outwardly projecting concave-convex dome or button 62 formed in the central panel 64 of the closure with V-shaped rib 66 formed across the center of the button. The closure 60 has a circular score line 68 therein in the center of the panel 64 and crossing the rib 66 at two locations. The score line could also be straight, but the circular score line 68 is preferred because it avoids any necessity of aligning the rib and score line so long as both are centered in the closure. The score line 68 is preferably formed in the undersurface of the closure 60 to avoid accidental rupture of the score when the button 62 is formed.

The button 62 preferably has a diameter of approximately 0.700 to 0.950 inch and a height of approximately 0.030 to 0.045 inch. The button is preferably recessed in the center portion of the closure to shield the button from being accidentally depressed which would result in premature rupture of the score line. An annular wall portion 72 which extends outwardly from the recessed center portion is believed to facilitate depressing the button 62 by providing a hinge or toggle effect which permits the base of the button to expand radially outward. In the absence of such annular wall portion 72, the base of the button would be substantially rigidly contained by the surrounding metal which would make it more difficult to depress the button. The annular wall portion 72 may be formed by a combination of drawing and extrusion of metal which thins the metal in the wall portion. Thinning the metal in the wall portion 72 during forming weakens such wall portion and facilitates outward expansion of the base of the button 62 by the hinging or toggle effect produced by such wall portion.

The closure 60 of FIGS. 6 and 7 is opened in the same manner as the closure illustrated in FIGS. 1–3, i.e., by applying digital pressure against the closure in the area of the rib 62 to stress the rib, and especially the residual metal in the score line 68 where it crosses the rib. The score line may rupture at either one or both locations where it crosses the rib. With the rib formed inwardly in the opposite direction from which the opening force is applied, the residual metal in the score line 68 is stressed in tension which ruptures the metal with a minimum of digital pressure.

Instead of threads or other retaining means, the closure 60 may have a friction or slight interference fit with the container, so it will frictionally engage the container after venting and after the pilferproof band has been separated from the top portion of the closure. The friction fit may be provided by circumferentially spaced projections or lugs, not shown, on either the outer surface 76 of the container or on the closure skirt 78, which will permit the closure to resiliently deform between such projections to fit over the container mouth.

Figure 8:
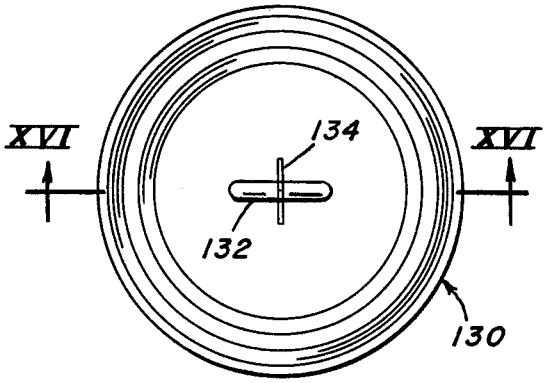
FIG. 8 is a top plan view of another alternative embodiment of a closure of this invention.
Figure 9:
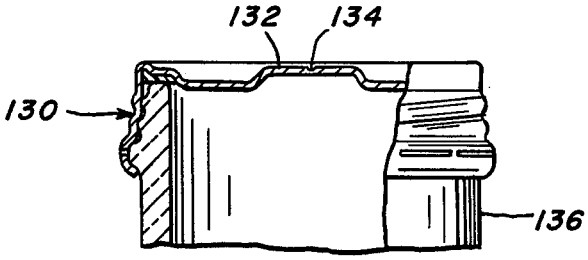
FIG. 9 is a partial cross-section through the closure of FIG. 8 taken along line XVI—XVI and showing the closure sealed on a container.

FIGS. 8 and 9 illustrate another alternative embodiment of the invention which is particularly adapted to automatically open or vent when the pressure in a container on which the closure is sealed becomes excessive and could otherwise burst the container. Closure 130 may be substantially the same as closure 10 illustrated in FIGS. 1 and 2 except that rib 132 in closure 130 is formed upwardly. A score 134 is preferably cut in the upper or exterior surface of the closure, but may also be cut in the interior surface of the closure. When pressure becomes excessive in container 136 on which closure 130 is sealed, the end wall of the closure will dome upwardly, which will stress rib 132 and rupture score 134 to permit venting of the container. The rib 132 and score 134 can be designed so that the score will rupture at a particular pressure. The pressure at which the score will rupture is dependent upon several parameters including the depth and shape of the rib, the residual metal thickness in the score, the material of which the closure is made and the diameter of the central panel in the closure among other parameters which can be controlled to provide desired venting characteristics for such closure.

Although the attached drawings and above description relate to three preferred embodiments of the invention, it will be apparent to those skilled in the art that various modifications could be made in the embodiments without departing from the invention. For example, an end closure of the invention could be made of a variety of sheet materials such as plastic, paper, metal or a laminate of such materials. Further, the flexible portions or buttons in end closures of the invention could be given a variety of shapes and forms for stressing a rib or ribs across the score line in such end closures, and the ribs in such end closures can be given a variety of configurations and depths. For example, the invention may comprise a circular rib with a dome in the middle and one or more scores across the rib to be ruptured while the dome is depressed to flex the rib. The invention can also be employed in either can ends, end closure or other container walls, and can be used to form a pouring or drinking opening, a vent to release either pressure or a vacuum from a container upon opening, a vent to admit air into a container during drinking or pouring, or as a safety release which will automatically break open when excessive pressure is built up in a container. Can ends and end closures embodying the invention can also be affixed or sealed on containers by a variety of means such as a double seam, roll-on threads, screw-on threads, lugs, or a crimped or constricted bead or edge portion on the closure.

What is claimed is:

1. A container wall having a score line therein for forming an opening in the wall and an integral hollow rib in the container wall across the score line projecting from the plane of the container at least five times the material thickness opposite the direction from which opening pressure is to be applied to stress the material in the score across the rib in tension and fracture such material.

2. A container wall as set forth in claim 1 in which the rib projects from the plane of the container wall a distance of at least seven times the material thickness.

3. A container wall as set forth in claim 1 in which said rib is substantially V-shaped.

4. A container wall as set forth in claim 1 in which said rib projects inwardly into a container for rupture of said score line by digital pressure against the exterior surface of the container wall.

5. A container wall as set forth in claim 1 in which said rib projects outwardly from the container wall for rupture of said score line when loaded and stresses by excessive pressure in a container on which the container wall is sealed.

6. A container wall as set forth in claim 1 in which said rib has a relatively sharp corner at its apex.

7. A container wall as set forth in claim 1 in which said rib has a maximum metal section therein along its length on the side thereof which will be in compression when the rib is loaded to rupture said weakening line.

8. A container wall as set forth in claim 1 in which said rib has a relatively wide base.

9. A container wall as set forth in claim 1 in which said rib crosses said weakening line substantially perpendicular to the weakening line.

10. A container wall as set forth in claim 1 which is made of hard temper aluminum alloy sheet material.

11. A container wall as set forth in claim 1 in which the material in the base of the rib is thinner than the adjacent material in the container wall.

12. A container wall as set forth in claim 11 in which said rib is formed by drawing a groove in a metal closure and coining the metal in the base of the groove to form a rib of requisite height.

13. A sheet metal container closure comprising an end wall for closing a container and having a score line therein and an integral substantially V-shaped hollow rib in the wall across the score line projecting from the plane of the wall toward the interior of the container a distance of at least seven times the metal thickness, said score line being adapted to be ruptured in response to digital force applied against said rib to form a vent opening in said end wall.

14. A container wall having a score line therein for forming an opening in the wall and an integral hollow rib in the container wall across the score line, said hollow rib having a projection measured perpendicular to the general plane of the container wall of at least five times the material thickness opposite the direction from which opening pressure is to be applied to stress the material in the score line across the rib in tension and fracture such material.

15. A container wall as set forth in claim 14 in which said rib has a relatively small radius at its apex.

16. A container wall as set forth in claim 14 in which said rib has a projection of at least seven times the material thickness.

17. A container wall as set forth in claim 16 which includes an annular wall portion around the base of said button.

18. A container wall as set forth in claim 14 which includes a concavo-convex button with said rib formed across the center thereof.

19. A container wall having a score line therein and an integral hollow rib in the wall across the score line projecting into the container at least five times the material thickness for locally stressing the material in the score line across the rib in tension to fracture such material when pressure is applied against the exterior surface of the wall.

20. An end wall for a container including a concavo-convex button projecting outwardly from the wall, a hollow rib projecting inwardly of the container across the center of the button and a score line across the rib which will be ruptured by pressure applied against the exterior surface of the wall.

21. An end wall as set forth in claim 20 in which said rib projects toward the inside of the container a distance of at least five times the thickness of the material in the wall.

22. An end wall as set forth in claim 20 which includes an annular wall portion around the base of said button.

23. A metal container wall having a score line therein for forming an opening in the wall and an integral hollow rib in the wall across the score line projecting into the container multiple times the metal thickness for locally stressing the metal in the score line across the rib in tension to fracture such metal when force is applied against the exterior surface of the wall at the score line.

24. A container wall as set forth in claim 23 in which said rib is at least 0.5 inch long and said score line crosses said rib near its middle.

* * * * *